United States Patent [19]

Holtgreve

[11] Patent Number: 4,955,167

[45] Date of Patent: Sep. 11, 1990

[54] ROOF VENT PIPE

[75] Inventor: Johannes Holtgreve, Schwelm, Fed. Rep. of Germany

[73] Assignee: Hans Klöber AG, Ennepetal, Fed. Rep. of Germany

[21] Appl. No.: 338,875

[22] Filed: Apr. 14, 1989

[30] Foreign Application Priority Data

May 7, 1988 [DE] Fed. Rep. of Germany ..... 8806101

[51] Int. Cl.[5] ..... E04H 12/28

[52] U.S. Cl. ..... 52/199; 98/78; 98/122

[58] Field of Search ..... 52/199; 98/122, 83, 98/79, 78, 86.5

[56] References Cited

U.S. PATENT DOCUMENTS 510,884 12/1893 Bradley, Jr. ..... 98/122

1,490,186 4/1924 Rowe ..... 98/122

1,549,813 8/1925 Spring et al. ..... 98/78

*Primary Examiner*—Carl D. Friedman

*Assistant Examiner*—Linda J. Hoffert

*Attorney, Agent, or Firm*—Martin A. Farber

[57] ABSTRACT

A roof vent pipe (1) having a mouth-side grid structure (G) is formed at least in part of annularly extending spokes and a cover cap (2) located above the spokes. The cap is interengaged via downward directed projections with the upper pipe end. To obtain an optimal attachment of the cover cap, a central projection (4) of the cover cap (2) engages in form-locked manner into the inside of an annular spoke (6). Support fingers (10) rest on at least one further outward lying annular spoke (11) are arranged concentrically thereto, and protrude from the lower side of the cover cap.

12 Claims, 4 Drawing Sheets

FIG. 1
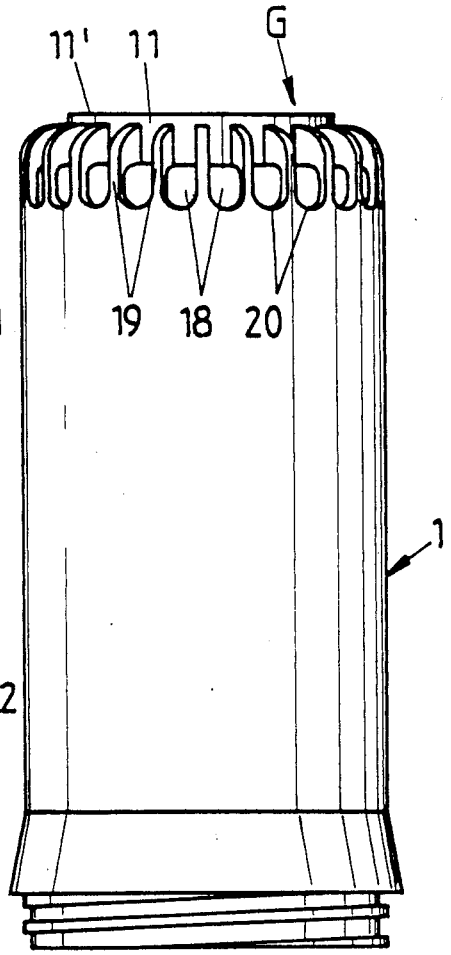
FIG. 2
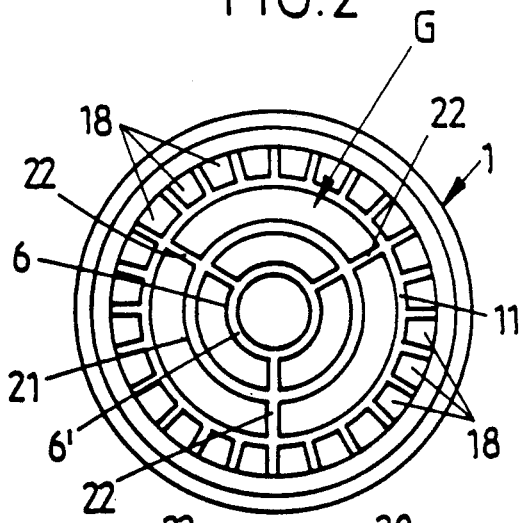
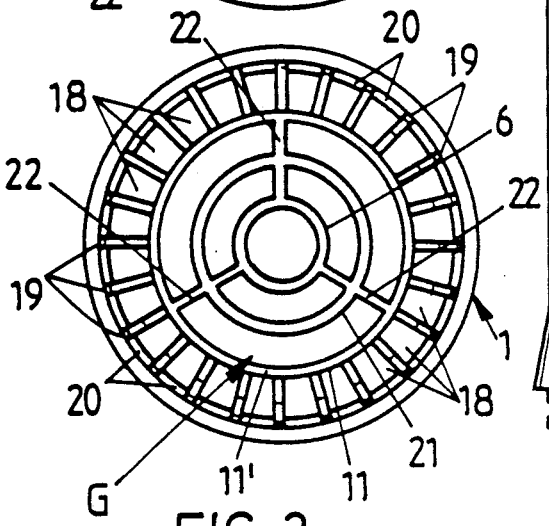
FIG. 3

ROOF VENT PIPE

FIELD AND BACKGROUND OF THE INVENTION

The present invention refers to a roof vent pipe with mouth-side rib structure (G) formed at least in part of annularly extending spokes, and above same a cover cap (2) which is locked via downward directed projections to an upper pipe end.

In one roof vent pipe of this type which is available on the market, three projections arranged at an equal angle apart extend from the cover of the cover cap. They are seated in the vicinity of the edge and grip below a peripheral annular rib on the mouth-side grid structure of the roof vent pipe. The supporting is effected via ledges which are developed directly on the projections. Viewed in cross-section, there is thus a T-profile of the projection shaft. The actual support is formed by the downward directed front end of the web. This development is disadvantageous since the webs which are formed o the shaft of the projections dampen the resiliency which is important for the attachment. This results in a rather hard detent behavior which, in the most unfavorable case, may even lead to a breaking off of the mating detent means, i.e., annular rib, of the grid structure. If a greater tolerance range is taken as basis, this can, in the event of a storm, lead to a lifting off of the cover cap, resulting in damage to persons or property.

SUMMARY OF THE INVENTION

The object of the present invention is to develop a roof vent pipe of this type in a simple and durable manner and in a way which is independent of tolerance.

This object is achieved, in accordance with the invention, by a central projection (4) of the cover cap (2) which engages in form-locked manner into the inside of an annular spoke (6), there being supporting fingers (10) which rest on at least one further outward annular spoke (11) and which are arranged concentrically to protrude from the lower side of the cover cap.

The invention provides for a roof vent pipe which is of increased value in use and increased safety: Because the detent and support regions are separated from each other. The support/detent action present on different parts and places results in a better distribution of the holding forces. Furthermore, the projections can be shaped optimally in accordance with their function, also from the standpoint of the selection of their material. The corresponding premises apply to the support fingers. In this connection, one advantageously proceeds concretely in the manner that a central projection of the cover cap engages in form-locked fashion into the inside of a annular spoke, and support fingers which rest on at least one further outward lying annular spoke arranged concentrically thereto extend from the lower part of the cover cap. The interengagement is therefore concentrated on a central region.

An assembler, therefore, need not—as in the predecessor described—direct or control his attention on the correct interengagement of three detent places which are far apart from each other. The support fingers, which now are completely free of each other, can also be better controlled from a standpoint of molding technique. Their further outward lying position leads to a balanced, almost automatic, support requiring no particular attention for attachment of the cover cap on the mouth-side grid structure.

From the standpoint of molding technique and stabilization, it then furthermore proves advantageous that the central projection is formed as a sleeve which is slit at the end. The sleeve shape as such results not only in a saving of material, which today is definitely of interest, but also in high flexibility despite a sleeve wall which is as thin as possible. The slitting only at one end divides the projection into a dowel-pin-like region and an anchoring region.

In accordance with an advantageous further development, the former, like the support fingers, is rooted in a depression arranged in the bottom of the cover cap. This depression forms a dome on the topside of the cover cap. The dome, which is formed practically from an off-set wall region of the cover cap, can, by reduction in thickness of its wall, also have a certain membrane-like flexibility, thus with respect to the projection, even clamping forces can be applied in the sense of an even non-rotatable clamping of the cover cap on the grid structure of the roof vent pipe. The further outlying supporting fingers are involved less, if at all, in this axial-central springability.

For reasons of stabilization as well as optical and visual reasons, it is advantageous that radially directed grooves which extend up into the outer wall of the cover cap extend from the dome. The corresponding ribbing, despite considerable thinness of the wall of the cover-cap material, creates stable conditions in this edge region. A corresponding grid structure results also with respect to the roof vent pipe, namely, that the pipe end has grid openings which extend up into the outer wall of the pipe and are formed by vertical spokes which extend on edge from an outermost annular spoke and open into the circumferential wall. The coherent circumferential wall of the pipe is thus formed of a plurality of radially oriented wall parts. This leads to a favorable, directed air flow behavior (lamellae), Furthermore grid openings are covered by the outer wall of the cover cap, so that driven-rain or driven-snow, leaves, etc. cannot penetrate into the grid structure which continues into a partial region of the outer wall of the pipe.

It is furthermore of advantage that vertical spokes are attached below the edge of the outermost annular spoke. The corresponding planar offset leaves an exposed position for the grid structure. The annular spoken are connected by three radial spokes. These radial spokes, which may suitably lie in equal angular distribution, lead to an extremely stable grid connection. Finally, another advantageous feature is that the support fingers rest on the outermost annular spoke and are arranged in uniform angular distribution. The larger cross-sectional length of the support fingers lies, in this connection, advisedly in the radii and therefore in crosswise arrangement to the said annular spoke.

BRIEF DESCRIPTION OF THE DRAWINGS

The object of the invention is explained in further detail below with reference to an embodiment shown in the drawing, in which:

FIG. 1 shows the roof vent pipe of the invention in its side view, without cover cap, FIG. 2 is a corresponding bottom view, FIG. 3 is a top view of the roof vent pipe.

DETAILED DESCRIPTION OF THE PREFERRED EMBODIMENT

Figure 7:
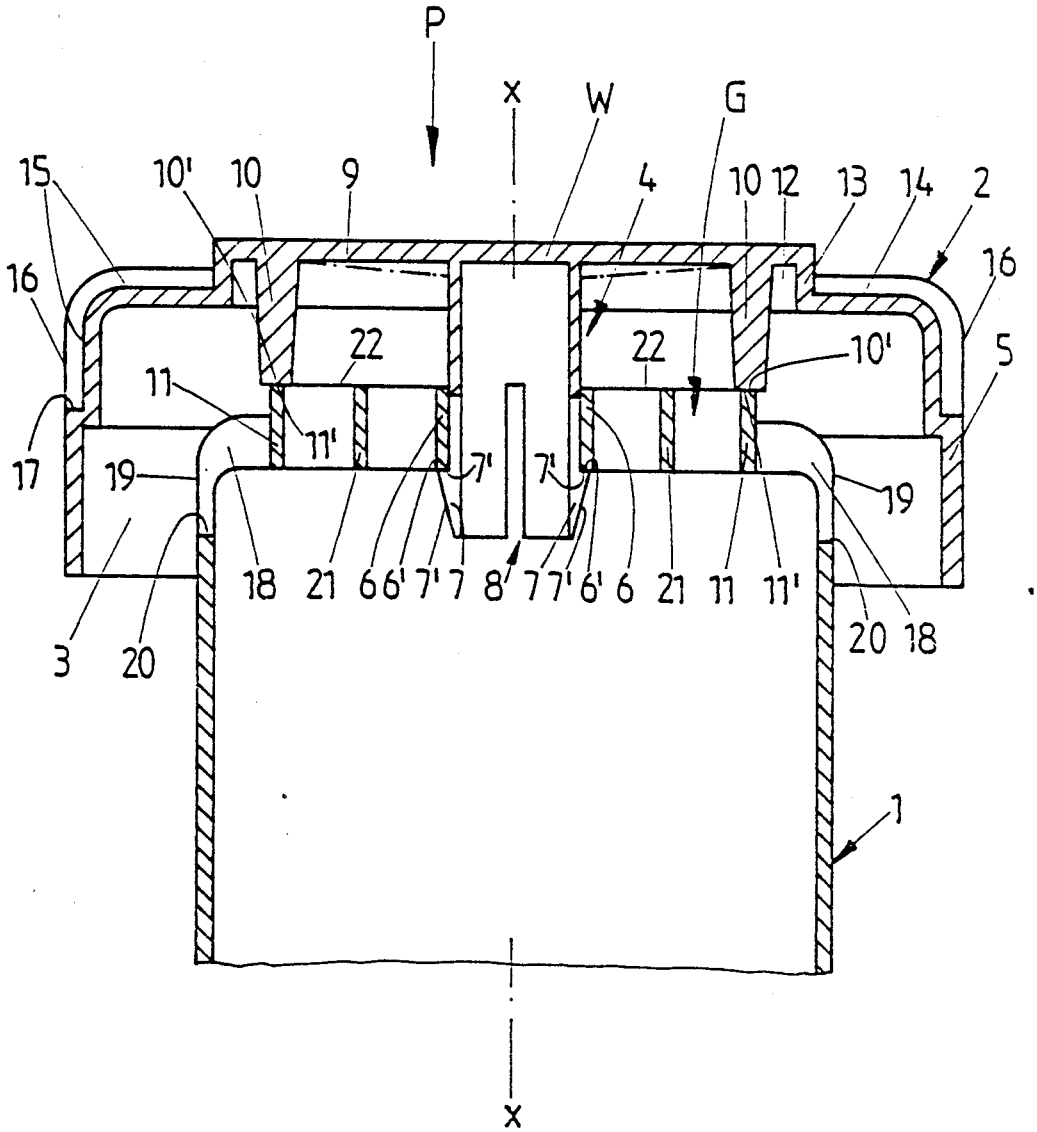
FIG. 7 is a vertical section through the roof vent pipe provided with the cover cap.

The roof vent pipe 1 whIch passes through the roof boarding of a house is covered on its mouth side by a cover cap 2 (FIG. 7). The latter can be attached by means of the supported plug-detent attachment. It can be a reversible type of attachment.

Between the surrounding cover cap 2 and the mouth-side end of the vent pipe 1 there is a space on all sides, designated 3, as a result of the requirements of fluid mechanics.

Plug-type interengagement and supports are effected at different places via different parts. The means producing the interengagement are located in the center of the roof vent pipe 1 and therefore on the longitudinal central axis x—x. There is a central cylindrical projection 4. The projection is developed on the cap 2. Its axial length is shorter than the axial length of an outer wall 5 of the cover cap 2.

A detent anchoring of the projection 4 is effected in the center of a grid structure G on the upper pipe end of the roof vent pipe 1 and in form-locked manner within an inner annular spoke 6. It is of cylindrical shape. The lower edge 6' of the inner annular spoke 6 is gripped beneath by the steep flank 7' of a detent nose 7.

As a result of transverse slitting of the end of the projection 4, which is developed as a sleeve, there are a total of four detent noses 7, the outwardly directed back of which extends at an acute angle to the longitudinal central axis x—x and therefore has a conical tapering toward the bottom so that each of the four detent noses 7 has a run-on bevel 7'' which favors the plug-in detent connection.

Figure 6:
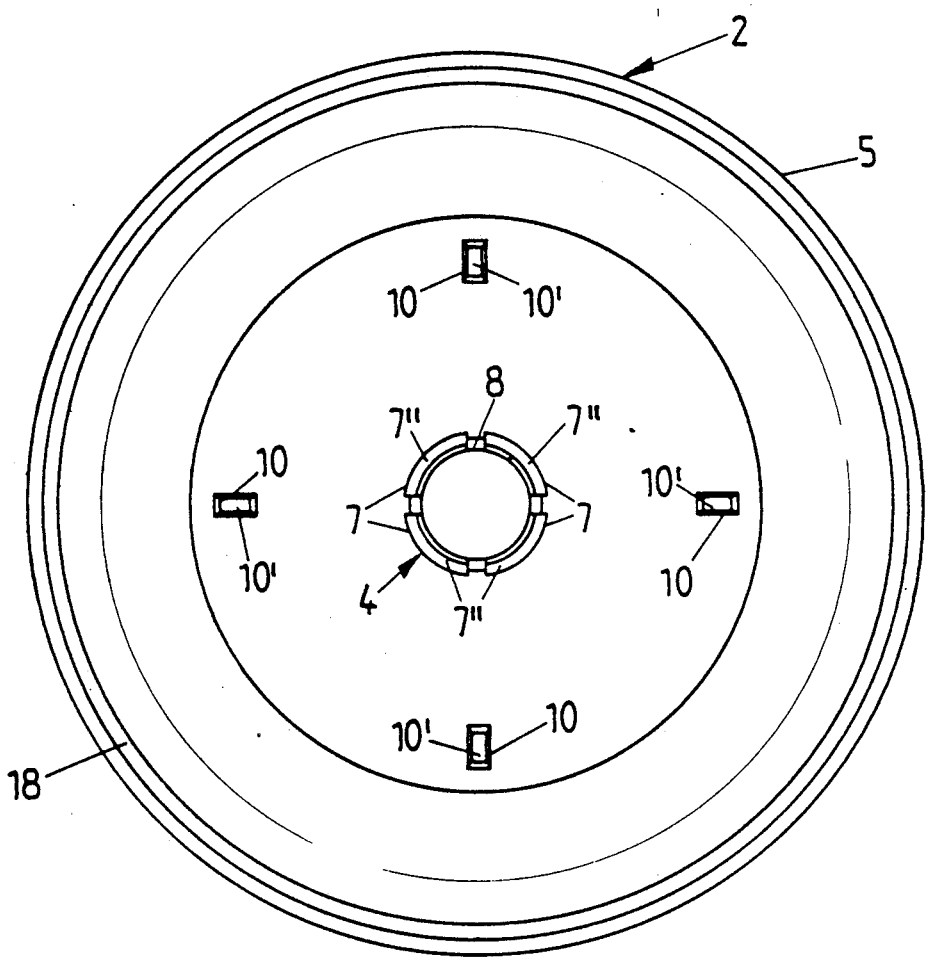
FIG. 6 is an inside view of the cover cap.

The cross slitting, which can be clearly noted from FIG. 6, has as a whole a width which extends in circumferential direction which permits a bundling of the detent noses 7 to below the inside cross-section of the inner annular spoke. The steep flank 7' of each detent nose 7 extends horizontally and therefore parallel to the plane of the end edge 6' of the annular spoke. The cross-wise slits are designated 8. Their axial length, extending from the free end of the projection, is of such size that the base of the slit terminates within the annular spoke 6 (see FIG. 6). In this way, a portion which can no longer be reduced in cross-section remains as cylindrical pin in the inside.

A sleeve cavity extends up to the height of the cover inner side 9 of the cover cap 2.

The supporting means are off-center. They consist of freely protruding supporting fingers 10 which extend from the bottom of the cover cap 2. A total of four such supporting fingers 10 are provided in equal angular distribution. The spatial arrangement with respect to the cross-wise slit 8 is such that they are aligned with the latter. The supporting fingers 10 are of rectangular shape as seen in cross-section. The longer side of the rectangle extends approximately in the radii. As can be clearly noted from FIG. 7, the narrow sides of the supporting fingers assume a course which diverges in the direction of the grid structure G.

The support abutment forms here at least one other annular spoke 11 further toward the outside. This spoke extends concentrically to the inner annular spoke 6. The ring-shaped circumferential end surface 11' of the annular spoke 11 is covered over cross-wise by the corresponding bottom side 10' of the supporting fingers 10. This bottom side is larger in surface than the thickness of the annular spoke 11 measured in these radii.

Projection 4 and supporting fingers 10 extend, with due consideration of the selected pot-shape of the cover cap 2, from a depression arranged on the bottom thereof, which depression, however, in view of the association for use on the top of the cover cap, forms a dome 12. The latter is of relatively slight height and passes, via a cylindrical annular wall 13 which is directed concentrically to the outer wall 5 of the cover cap 2, into the top side 14 of the cover cap 2.

A wall W which forms the bottom or the roof of the dome 12 may be developed with a thinner wall so that it creates a sort of flexible membrane. In this way, the centrally arranged projection 7 can even be held under axial tension in the manner that the steep flank 7' of the detent noses 4 terminates in the basic position slightly in front of the front surface 6' so that by the exerting of a compressive force in the direction indicated by the arrow P with corresponding axial displacement, the barb-like projection 4 snaps behind the end surface 6'. The supporting fingers 10 which are arranged in this connection more in the edge region of the dome 12 are practically not included herein, i.e., displaceable.

Figure 4:
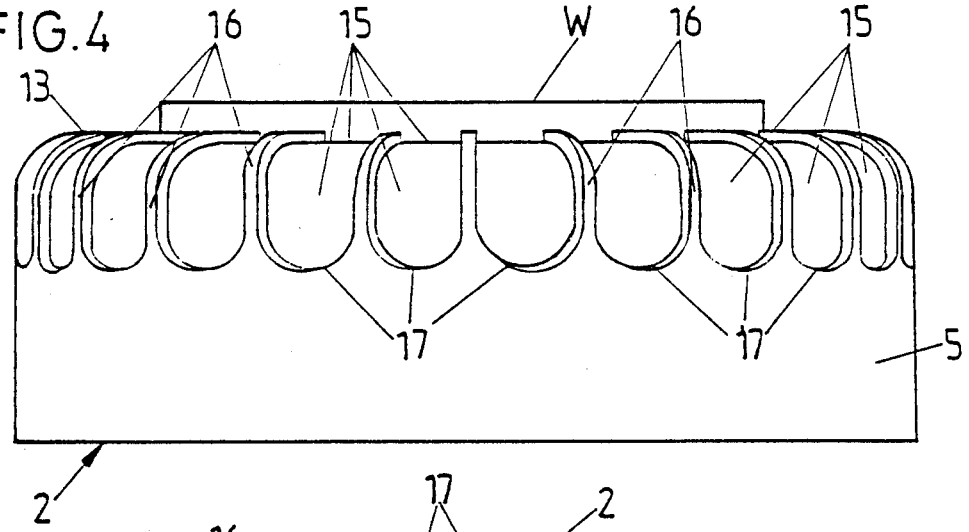
FIG. 4 shows the corresponding cover cap by itself in side view, enlarged.
Figure 5:
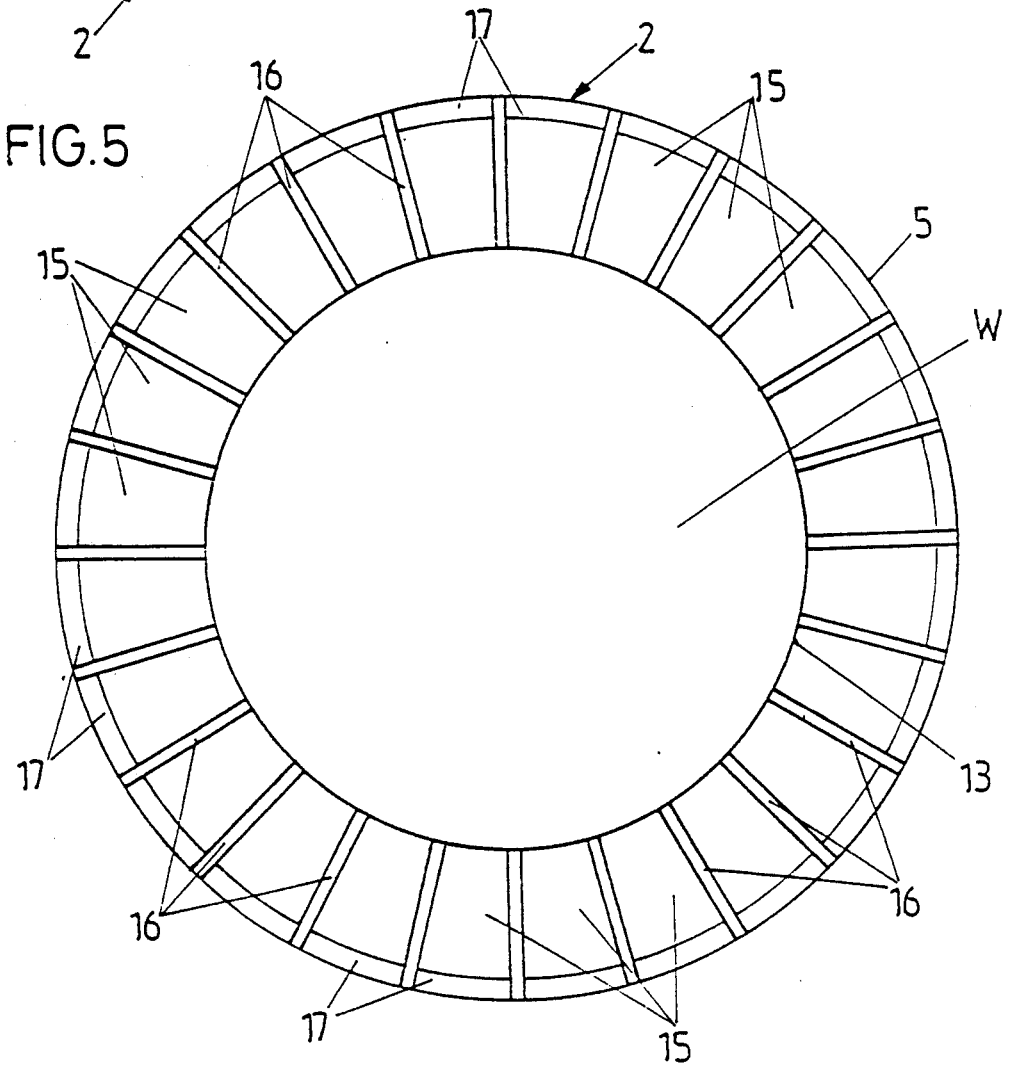
FIG. 5 is a top view thereof.

As can be noted from FIGS. 4 and 5, radially directed grooves 15 arranged on the top side 14 extend from the dome 12 and the outside of the annular wall 13, respectively. These grooves extend even over the convexly rounded edge between top 14 and outer wall 5 up into the latter. Between the individual grooves 15 there remain webs 16 which are connected via concavely rounded groove sections 17. At the height of these groove sections 17, the outer wall 5 forms a projection 30 which can be noted from FIG. 6. The wall thickness is maintained the same in the two regions, except for the parts which, due to the radial webs 16, have about twice the accumulation of material. The corresponding region is extremely stable.

The pipe end has grid openings 18 extending up into the pipe outer wall. The openings are limited by vertical spokes 19 which extend on edge from the outermost annular spoke 11 and terminate in the said outer wall of the roof vent pipe 1. The connection of the grid structure G, accordingly, is also extremely stable. The wall thickness of the vent pipe 1 corresponds to the thickness of the vertical spokes 19. While the pipe-side transition region between the radially directed vertical spokes 19 is concavely rounded, the inversely directed ends of the vertical spokes 19 pass blunt into the outer surface of the outermost annular spoke 11. The concave rounding bears the reference number 20.

As can be noted from FIG. 7, the grid openings 18 are covered in bell-edge-like fashion by the outer wall 5, extending concentrically in front thereof, of the cover cap 2. An overlapping arrangement may suitably be effected (see FIG. 7). On the top, the vertical spokes 19 pass below the upper edge 11' of the outermost annular spoke 11. Referred to the abutment, there is a plateau-like protrusion.

Between the innermost annular spoke 6 and the outermost annular spoke 11 there is furthermore a middle annular spoke 21. It also extends concentrically to the adjacent annular spokes 6,11 of rotational symmetry. These spokes are connected together by radial spokes 22. As a whole, three such radial spokes are produced.

The latter have the same angular distances from each other and are aligned in each case with a vertical spoke 19 joining from the outside, of which a total of 24 are provided.

The lower end of the roof vent pipe 1 can have a screw thread in the connection to a flange for attachment to a final pipe part (not further shown) arranged in a joint.

I claim:

1. A roof vent pipe comprising a pipe having at an upper end thereof, formed in one piece therewith, a mouth-side rib structure formed at least in part of annular spokes; and a cover cap disposed above the spokes; and wherein the cover cap comprises a central portion with downward directed projections, the projections including a central projection extending from the central portion and supporting fingers extending from the central portion;

the cover cap is locked via said central projection to the upper pipe with said central projection of the cover cap forming a detent member detent engaging in form-locked manner into an inside of one of said annular spokes of said rib structure; and said supporting fingers rest on at least one further outward of said annular spokes of said rib structure and are arranged concentrically projecting from a bottom of the cover cap at said central portion.

2. A roof vent pipe according to claim 1, wherein said central projection is formed as a sleeve which is slit on one end constituting said detent member.

3. A roof vent pipe according to claim 1, wherein said cover cap at the central portion in the bottom of the cover cap forms a depression; and said central projection and said supporting fingers extend from said central portion in the depression.

4., A roof vent pipe according to claim 3, wherein said central portion in said depression forms a dome on a top of the cover cap.

5. A roof vent pipe according to claim 4, wherein the cover cap comprises an outer wall; and said cover cap is formed with radially directed grooves which extend from the dome up into the outer wall of the cover cap.

6. A roof vent pipe according to claim 1, wherein said rib structure has vertical spokes; and the upper end of said pipe has grid openings which extend up into an outer wall of the pipe, and are formed by said vertical spokes which extend on edge from an outermost annular spoke and open into the outer wall of the pipe.

7. A roof vent pipe according to claim 6, wherein the cover cap has an outer wall encircling the central portion; and said grid openings are covered by the outer wall of the cover cap.

8. A roof vent pipe according to claim 6, wherein said vertical spokes are integrally joined below an upper edge of said outermost annular spoke.

9. A roof vent pipe according to claim 1, wherein said rib structure comprises three radial spokes integrally joined to said annular spokes, there being three of said annular spokes.

10. A roof vent pipe according to claim 1, wherein the supporting fingers abut on an outermost annular spoke and are arranged at equal angular distance apart.

11. A roof vent pipe according to claim 1, wherein said central portion comprises a flexible membrane.

12. A roof vent pipe according to claim 1, wherein said annular spokes terminate in a common upper plane which partially constitute a rest surface for said supporting fingers.

* * * * *